US005390434A

United States Patent [19]

Lockard

[11] Patent Number: 5,390,434

[45] Date of Patent: Feb. 21, 1995

[54] CLOTHING ACCESSORY LABEL

[75] Inventor: Randall R. Lockard, Coppell, Tex.

[73] Assignee: TBAC Investment Trust, Arlington, Tex.

[21] Appl. No.: 2,665

[22] Filed: Jan. 11, 1993

[51] Int. Cl.[6] ..... G09F 3/10

[52] U.S. Cl. ..... 40/299; 40/316; 40/310

[58] Field of Search ..... 40/299, 310, 316, 321, 40/322, 360, 586

[56] References Cited

U.S. PATENT DOCUMENTS

| | | | |
|---|---|---|---|
| 916,672 | 3/1909 | Charbeneau | 40/321 |
| 1,215,051 | 2/1917 | Nagel | 40/321 |
| 1,405,148 | 1/1922 | Nagel | 40/321 |
| 1,460,641 | 7/1923 | Broome | 40/321 |
| 2,816,653 | 12/1957 | Jacobi | 40/299 |
| 3,407,781 | 10/1968 | Ardire et al. | 40/299 |

FOREIGN PATENT DOCUMENTS

| | | | |
|---|---|---|---|
| 473057 | 11/1954 | Italy | 40/310 |
| 5331 | of 1899 | United Kingdom | 40/321 |

*Primary Examiner*—Clifford D. Crowder
*Assistant Examiner*—Gloria Hale
*Attorney, Agent, or Firm*—Winstead Sechrest & Minick

[57] ABSTRACT

A label is disclosed that provides an economical and convenient means of securing information regarding product promotion, pricing, and manufacturing to clothing accessories. The disclosed label encircles the labeled accessory and has a flap extension for insertion through a loop of material affixed to the labeled accessory, and attaching to the bottom of the two flaps that encircle the accessory. The disclosed label provides sufficient surface area for effective product promotion and a means of providing pricing information that is not easily or casually removed from its position on the labeled accessory.

3 Claims, 2 Drawing Sheets

CLOTHING ACCESSORY LABEL

TECHNICAL FIELD OF THE INVENTION

The present invention relates to a clothing accessory label and more particularly to a one-piece label adapted for use in labeling a necktie or a belt.

BACKGROUND OF THE INVENTION

Clothing accessories have been utilized by almost every culture throughout history as a way to add variety and creativity to individual dress. Today there is a large, competitive international market for such clothing accessories. Neckties, or ties, and belts enjoy a particularly active market throughout the world. Marketing ties and belts require that they be labeled. Retailers would like to label these accessories with advertisements, size information, name of manufacturer, information on the material from which they are constructed, pricing information, etc. Not only do retailers want to label these items with colorful attention-grabbing labels, but they must also provide essential information to potential customers such as size and pricing information.

Currently available labeling techniques for belts and ties are plagued with several problems. For example, they do not provide sufficient surface area for all of the information that retailers would like to display on these items. State of the art slip-on labels for ties and belts are very limited in the quantity of highly visible surface area available to allow retailers to effectively display product promotion and advertising information to the consumer.

In addition, available labels for ties and belts are not secured to the item labeled and may be easily removed or slipped off the item. This problem is particularly critical for certain information such as size and/or pricing information. Whenever this type of information is removed from a tie or belt, salespeople and potential purchasers must take the time and effort to find the information elsewhere. To avoid this problem retailers often double label ties and belts: firstly, with a paper sleeve to capture consumer attention; and, secondly, with a more secure tag, for example one attached by a string or a plastic or nylon thread, containing pricing and/or size information. However, labeling ties and belts with a string or thread, is labor intensive, expensive, time consuming, and potentially damaging to fine fabrics that may snag on the rough surface of the plastic material commonly used to hang tags with pricing information. Furthermore, some of the more secure methods of labeling clothing accessories require actual penetration of the accessory with a hang tag. This type of labeling is damaging to the labeled item and is unsuitable for labeling fine quality clothing accessories.

Furthermore, since currently used slip-on labels easily slide up and down the tie or belt during display and handling, it is difficult for retailers to consistently display the labels at maximum visibility. Not only do slip-on labels risk being removed or slipping off the labeled item altogether, they require constant straightening and rearranging by sales personnel.

Accordingly, a need exists for an economical, convenient means of labeling ties and belts that is not easily or casually removed from its position on the labeled item. Such a label should provide sufficient space for advertising, consumer product information, and pricing information.

SUMMARY OF THE INVENTION

The problems discussed above have been solved in the present invention which provides an economical, convenient means of securing labels to ties and belts. Ties and belts are generally made of long pieces of fabric or leather and have an affixed loop of material attached to them; i.e., a belt has a loop and a tie has a woven neckwear label on the back of the tie.

The present invention is a clothing accessory label that can encircle the labeled accessory and interlock with a loop of material affixed to the clothing accessory in order to secure the position of the label on the clothing accessory and prevent its casual removal.

Broadly, one embodiment is a one-piece relatively flexible label for use in labeling clothing accessories, the label comprising:

a front panel having a panel surface area and having a first flap having a first flap surface area extending outwardly along the plane of the panel surface area on one side of the panel surface area and a second flap having a second flap surface area extending outwardly along the plane of the panel surface area on a side of the front panel opposite from the one side, the first flap and the second flap each being foldable to encircle the clothing accessory; and an extension to the first flap extending substantially perpendicular to the first flap, the extension being foldable in conjunction with the folding of the first and second flaps to essentially secure the position of the label on the clothing accessory.

Broadly, another embodiment is a one-piece relatively flexible label for use in labeling clothing accessories, the label comprising:

a front panel having a panel surface area and having an adjoining flap having a flap surface area extending outwardly along the plane of the panel surface area on one side of the panel surface area, the flap being foldable to encircle the clothing accessory; and an extension to the flap extending substantially perpendicular to the first flap, the extension being foldable in conjunction with the folding of the flap to essentially secure the position of the label on the clothing accessory.

Broadly, still another embodiment is a two-piece label for use in labeling clothing accessories, the label comprising:

a front panel having a panel surface area and having a first flap having a first flap surface area extending outwardly along the plane of the panel surface area on one side of the panel surface area and a second flap extending outwardly along the plane of the surface area on a side of the front panel opposite from the one side, the first flap and the second flap each being foldable to encircle the clothing accessory; and a strip of material being foldable in conjunction with the folding of the first and second flaps and interconnectable with the first and second flaps to essentially secure the position of the label on the clothing accessory.

A preferred embodiment of the present invention is a one-piece flexible label that has two flaps that can encircle the tie or belt, one of the flaps having an essentially perpendicular extension that is to be folded perpendicularly to insert through a loop, or a piece of material that is affixed to the tie or belt to be labeled, and thus secure the label to the tie or belt. The disclosed label has a front panel that is visually displayed on one side of the clothing accessory and an extension which interlocks with a loop of material on the clothing accessory on the opposite side of the clothing accessory to where the front panel is displayed.

Accordingly, an object of the present invention is to provide a clothing accessory label with a highly visible surface area for displaying product promotion and advertising information to the consumer.

Another object of the present invention is to provide a label to be secured to a tie or belt such that it cannot be easily or casually removed from its position on the tie or belt to be labeled.

An additional object of the present invention is to provide a label having a space to print or affix a sticker with UPC bar code or related price information that is stably attached to the labeled tie or belt.

A further object of the present invention is to provide a label that has a consistent visual field that can be advantageously presented when the labeled item is displayed in either hanging or folded presentations.

Yet another object of the present invention is to provide a label that can speed up handling and marking operations by wholesalers and/or retailers by eliminating the need for string or bar tacking hang tags.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The problems discussed above, inherent in labeling clothing accessories have been solved in the preferred embodiment of the present invention as described below.

Figure 1:
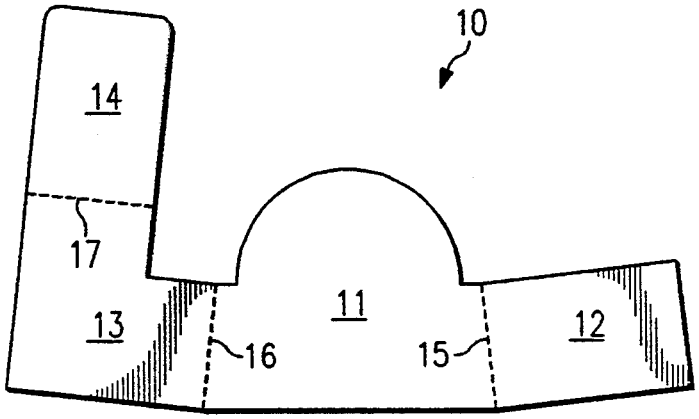
FIG. 1 shows a two dimensional representation of one embodiment of the label of the present invention.

FIG. 1 shows a two dimensional representation of one embodiment of label 10. Label 10 is comprised of four sections; front panel 11, first flap 12, second flap 13 and flap extension 14. Label 10 is scored between each of the two sections to form a crease, or folding line; i.e. crease 15 between front panel 11 and first flap 12, crease 16 between front panel 11 and second flap 13, and crease 17 between second flap 13 and flap extension 14.

Label 10 is a one-piece construction that may be manufactured from different types of materials such as paper stock in varying weights and thicknesses, plastic, fabric, or leather. Label 10 may be applied to a variety of clothing accessories (such as hats, belts, belted hat and watch bands, harnesses, and purses) in a similar manner as described below for a necktie.

Figure 2:
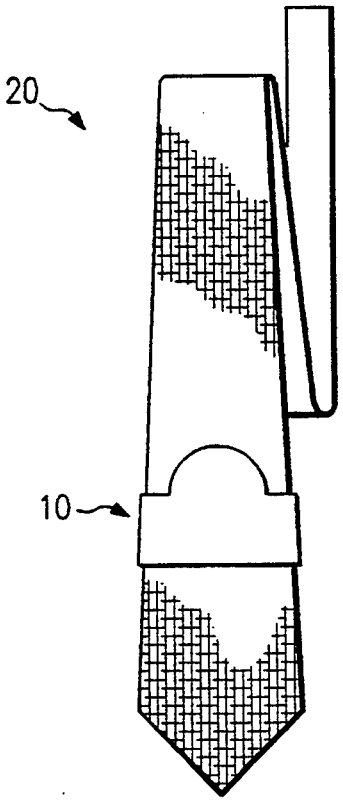
FIG. 2 shows one embodiment of the label displayed on the front of a necktie.

FIG. 2 shows a front view of label 10 as applied to tie 20. FIG. 2 illustrates how the top surface of front panel 11 is displayed on the front of tie 20. Although FIG. 2 illustrates the label as flat, the label could also be molded in several three dimensional configurations. The design of front panel 11 will vary in shape, size, and color as dictated by product promotion and advertising needs. Front panel 11 provides a highly visible profile for a labeled tie at the point-of-sale to capture consumer attention and to convey consumer information to potential purchasers.

Figure 3:
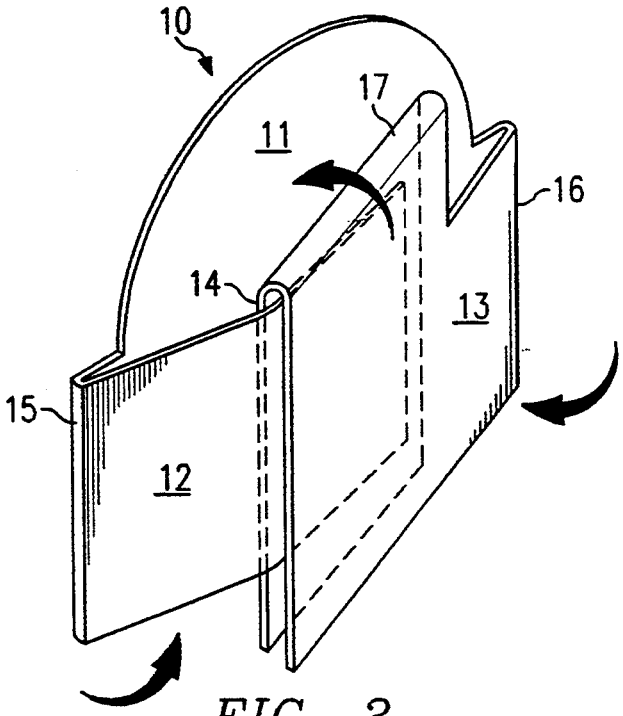
FIG. 3 shows one embodiment of the label partially folded.

FIG. 3 illustrates how label 10 is folded when it is applied to a necktie. Label 10 is laid front panel 11 backside down on the front of tie 20. Flap 12 is folded about 180 degrees, along crease 15, behind tie 20 such that the back-side of the first flap, flap 12, lies adjacent to the back of tie 20. The second flap, flap 13 is also folded about 180 degrees, along crease 16 inward in the same direction as flap 12 has been folded, such that it overlaps flap 12 and in conjunction with flap 12 encircles tie 20. Then flap extension 14 is folded perpendicularly about 180 degrees, along crease 17 toward the two folded flaps, 12 and 13, and inserted through the woven neckwear label on the back of tie 20. The far end of flap extension 14 is substantially aligned with the bottom of flaps 12 and 13 and secured to flaps 12 and 13.

Label 10 is prohibited from moving up and down along the tie by its insertion through the woven neckwear label. Stabilizing label 10's position along tie 20 allows retailers to display the promotional material printed on front panel 11 in either hanging or folded presentations. This not only optimizes consumer recognition of the labeled goods by presenting a consistent visual field to potential customers, but it also reduces the amount of housekeeping by sales personnel, i.e. the need to straighten ties and move the tie label along the length of the tie to provide maximum display of the label.

Figure 4:
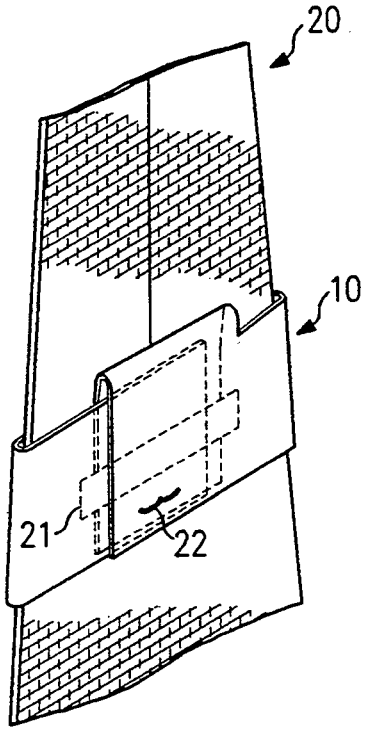
FIG. 4 shows one embodiment of the label displayed on the rear of a necktie.

FIG. 4 shows how the label is folded and secured to tie 20 by inserting flap extension 14 through the woven neckwear label affixed to the back of tie 20, loop 21, and attaching the distal end of flap extension 14 to the bottom edges of flaps 12 and 13. The distal end of flap extension 14 may be attached to flaps 12 and 13 by diverse means such as staple 22, a pre-applied adhesive, or an interlocking folding of flap extension 14 around flaps 12 and 13. Although FIG. 4 illustrates label 10 secured to loop 21 where loop 21 is shown positioned mid-way along label 10's height, in practice loop 21 would be positioned at the top edge of label 10 and would fit between flap 13 and flap extension 14 along crease 17.

The insertion of flap extension 14 of label 10 through loop 21 positions label 10 on tie 20 in a manner that it cannot easily slide up and down the tie and cannot easily slip off the tie during transport and display. Even when label 10 is inserted in loop 21 there is still sufficient room within loop 21 that the small end of a tie can be inserted therein if needed for display purposes.

The exterior surface of flap 13 gives a superior surface area for providing the consumer with additional product information and a space for printing or affixing a sticker with UPC bar code or related price information. Since this type of information is essential for the consumer, label 10 provides an economical, efficient, and secure means of displaying this type of information. Using label 10, retailers can avoid the necessity of double labeling ties with hang tags which are expensive, time consuming to install, and potentially damaging to fine fabrics. Secure labeling is particularly important in labeling ties, which unlike belts and other clothing accessories have no apparent loop to attach a label to. While belts have a belt loop and a buckle from which labels may be hung, a tie only has an inconspicuous woven tie label on its backside.

Figure 5:
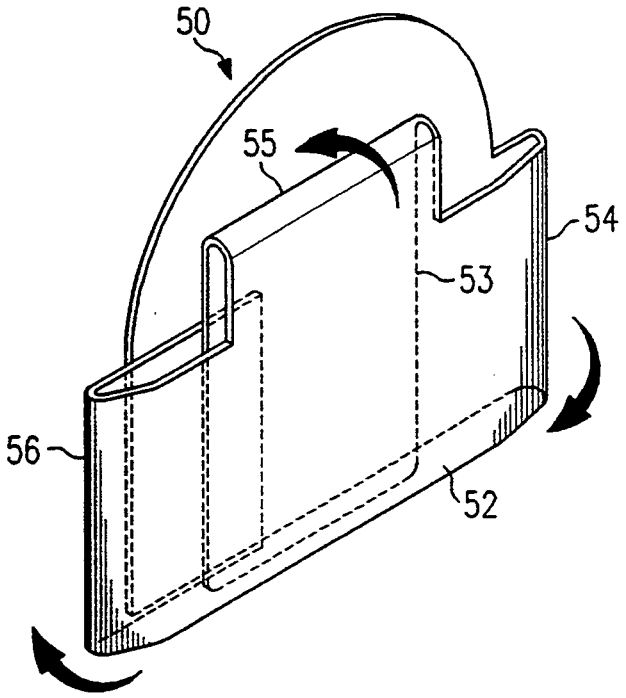
FIG. 5 shows an alternative embodiment of the label of the present invention.

FIG. 5 shows a two-dimensional representation of an alternative embodiment of the present invention. Label 50 is comprised of three sections; front panel 51, flap 52, and flap extension 53. Label 50 is a one-piece construction that may be applied to a variety of clothing accessories in a similar manner as described below for a necktie.

Label 50 is applied to a necktie by laying front panel 51 backside down on the front of the tie. Flap 52 is folded about 180 degrees, along crease 54 and crease 56, to encircle the tie and is affixed to the opposite side of front panel 51. Flap extension 53 is folded perpendicularly about 180 degrees, along crease 55 toward flap 52, and inserted through the woven neckwear label on the back of the tie. The far end of flap extension 53 is substantially aligned with the bottom of flap 52 and secured by an adhesive or a staple.

Figure 6:
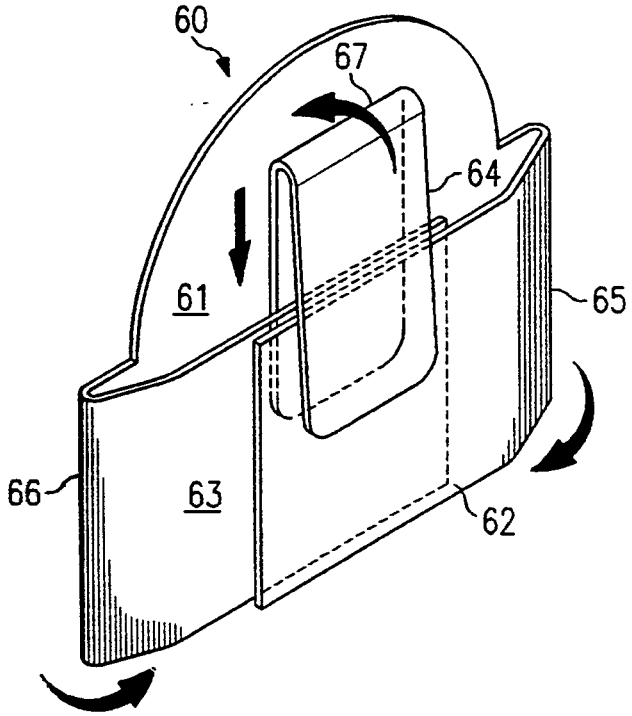
FIG. 6 shows an alternative two-piece embodiment of the label of the present invention.

FIG. 6 shows an alternative two-piece embodiment of the present invention. Label 60 is applied to a necktie by laying front panel 61 backside down on the front of the tie. The first flap, flap 62, is folded about 180 degrees, along crease 65, behind the tie such that the backside of flap 62 lies adjacent to the back of the tie. The second flap, flap 63, is also folded about 180 degrees, along crease 66 in the same direction that flap 62 has been folded, such that it overlaps flap 62 and in conjunction with flap 62 encircles the tie. A strip of material, strip 64, a separate piece of label 60, is folded about 180 degrees, along crease 67, and is inserted through the woven neckwear label on the back of the tie. The end of strip 64 is then aligned with the bottom of flaps 62 and 63 and secured to flaps 62 and 63 by an adhesive or a staple.

While preferred embodiments of the invention have been shown and described, it will be apparent to those skilled in the art that the conception of the specific embodiments described may be readily utilized as a basis for modifying or designing other labels for carrying out the same purpose as the present invention. It should also be realized by those skilled in the art that such equivalent constructions do not depart from the spirit and scope of the invention as set forth in the appended claims.

What is claimed is:

1. A method of installation of a label for use in labeling a clothing accessory having a loop of material on a back side thereof, said method comprising the steps of:

(a) laying said label flat, said label comprising:

a front panel having a panel surface area;

a first flap having a first flap surface area extending outwardly along the plane of said panel surface area on a first side of said panel surface area, said first flap having a width, wherein said first flap has a section distal to said front panel that extends in a substantially perpendicular direction from the direction in which said first flap extends from said front panel where said first flap adjoins said front panel;

a second flap having a second flap surface area extending outwardly along the plane of said panel surface area on a second side of said front panel, said second side of said front panel opposite from said first side; and an extension to said distal section of said first flap extending outwardly along the plane of said distal section;

(b) placing a backside of said front panel on a front side of said clothing accessory;

(c) folding said first and second flaps to encircle said clothing accessory;

(d) folding said extension to form a U-shaped enclosure, said enclosure traversing an area enclosed by said loop of material such that said U-shaped enclosure interlocks with said loop on an opposite side of said clothing accessory from where said front panel is displayed; and (e) attaching a distal end of said interlocked U-shaped enclosure to said first and second flaps to secure said label position with respect to said clothing accessory.

2. A method of installation of a label used to label a clothing accessory having a loop of material on a back side thereof, said method comprising the steps of:

(a) laying said label flat, said label comprising:

a front panel having a panel surface area;

an adjoining flap having a flap surface area extending outwardly along the plane of said panel surface area on one side of said front panel, said adjoining flap having a width, an end distal to said front panel, an end proximal to said front panel, and a section approximately midway between said distal end and said proximal end that extends substantially perpendicular to said proximal and distal ends; and an extension to said section of said adjoining flap extending outwardly along the plane of said section, said extension when added to said section, having a length longer than said width of said first flap;

(b) placing a backside of said front panel on a front side of said clothing accessory;

(c) folding said adjoining flap to encircle said clothing accessory;

(d) folding said extension to form a U-shaped enclosure, said enclosure traversing an area enclosed by said loop of material such that said U-shaped enclosure interlocks with said loop on an opposite side of said clothing accessory from where said front panel is displayed; and (e) attaching a distal end of said interlocked U-shaped enclosure to said adjoining flap to secure said label position with respect to said clothing accessory.

3. A method of installation of a two-piece label used to label a clothing accessory having a loop of material on a back side thereof, said method comprising the steps of:

(a) laying a first piece of said label flat, said first piece comprising a front panel having a panel surface area and having a first flap having a first flap surface area extending outwardly along the plane of said panel surface area on one side of said panel and a second flap having a second flap surface area extending outwardly along the plane of said panel surface area on a side of said front panel opposite from said one side;

(b) placing a backside of said front panel on a front side of said clothing accessory;

(c) folding said first and second flaps to encircle said clothing accessory;

(d) folding a second piece of said label to form a U-shaped part, said second piece comprising a strip of foldable material;

(e) placing said U-shaped part through said loop such that said U-shaped part interlocks with said loop on an opposite side of said clothing accessory from said front panel; and (f) attaching two open ends of said U-shaped part to said first and second flaps to secure said label position with respect to said clothing accessory.

* * * * *